United States Patent [19]

Kessler et al.

[11] 4,043,278

[45] Aug. 23, 1977

[54] KNOCK-DOWN LIGHT WEIGHT TABLE KIT

[75] Inventors: Milton Kessler, Youngstown; Myron E. Ullman, Jr., Canfield, both of Ohio

[73] Assignee: Kessler Products, Inc., Youngstown, Ohio

[21] Appl. No.: 685,803

[22] Filed: May 12, 1976

[51] Int. Cl.[2] ..... A47B 13/02

[52] U.S. Cl. ..... 108/150; 108/157

[58] Field of Search ..... 108/27, 150, 157–159; 248/158, 159; 52/716

[56] References Cited

U.S. PATENT DOCUMENTS

| | | | |
|---|---|---|---|
| 1,546,777 | 7/1925 | Deinhart | 108/150 |
| 1,767,134 | 6/1930 | Huye | 248/159 X |
| 2,024,330 | 12/1935 | Bemis | 108/150 X |
| 2,719,717 | 10/1955 | Verity | 108/27 X |
| 3,648,659 | 3/1972 | Jones | 248/158 X |
| 3,724,399 | 4/1973 | Notko et al. | 108/150 X |

*Primary Examiner*—James C. Mitchell

*Attorney, Agent, or Firm*—Meyer, Tilberry & Body

[57] ABSTRACT

A low table about the height of a coffee table, to be retailed as a kit of parts which can be quickly and simply assembled without tools, and which is made essentially of heavy cardboard or fiberboard finished to resemble wood, and consisting of a flat base, a hollow column fixed to said base, and a table top fixed to said column. The column is weighted with sand which is immobilized at the bottom of the column by means of hot wax or a similar agent.

12 Claims, 8 Drawing Figures

FIG. 1.
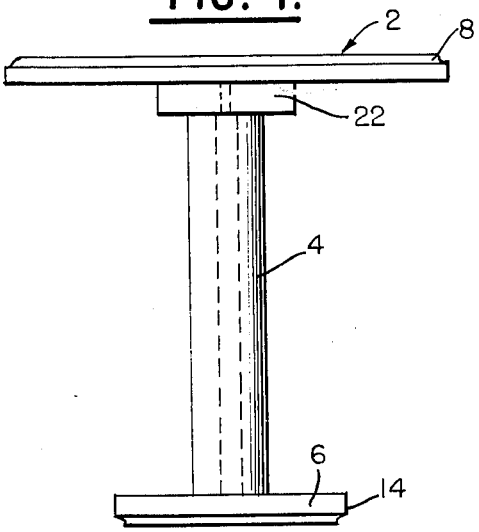
FIG. 6.
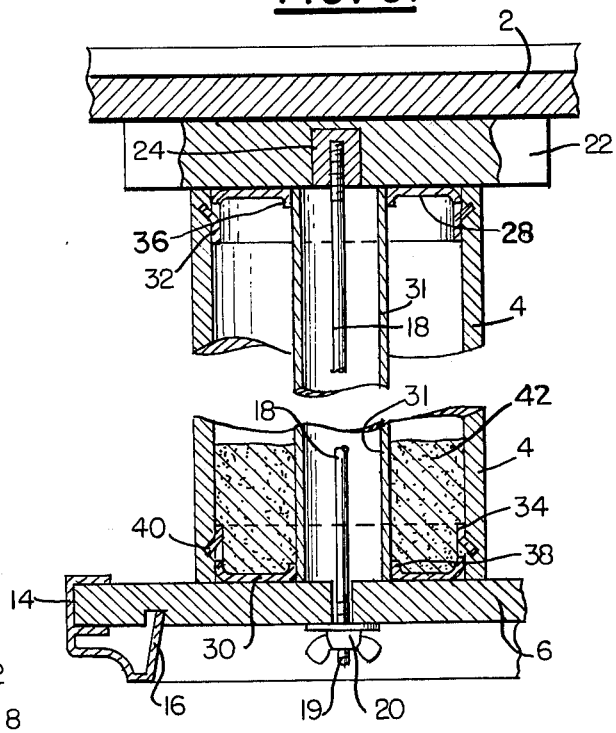
FIG. 2.
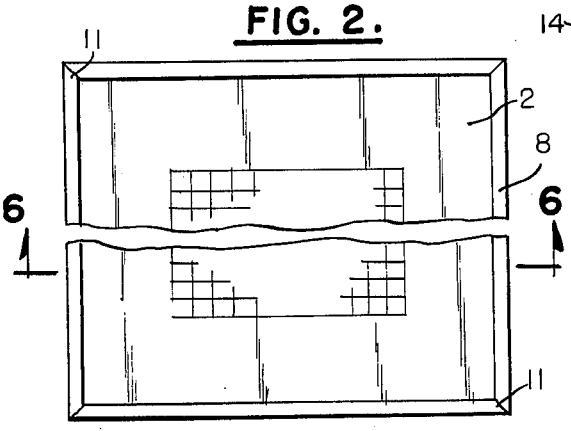
FIG. 3.
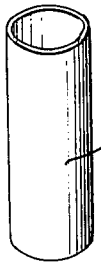
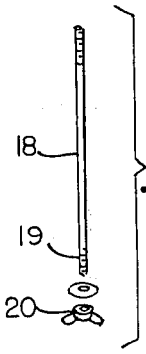
FIG. 4.
FIG. 7.
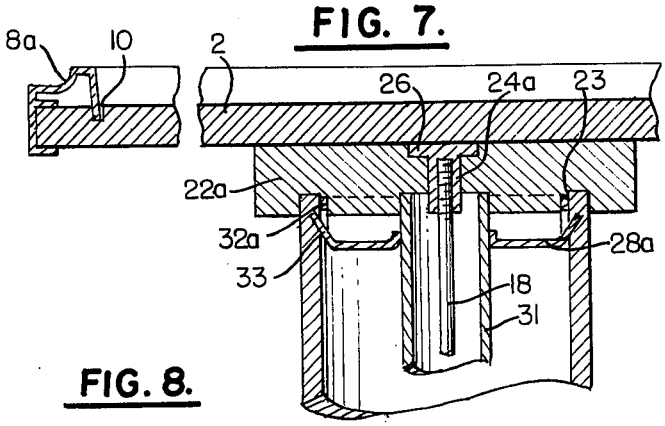
FIG. 5.
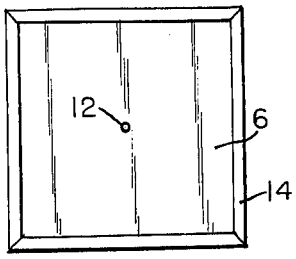
FIG. 8.
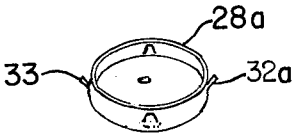

KNOCK-DOWN LIGHT WEIGHT TABLE KIT

The scarcity and increasing cost of wood has made wooden furniture prohibitively expensive for many people. It is a major object of the present invention to provide an alternative item of furniture in the form of a small table which is made entirely without natural wood but which looks like a wooden table, and which can be sold at a low cost in knock-down kit form for easy assembly by the purchaser, without tools. The table consists of a flat base member preferably made of chipboard, fiberboard, Masonite, or some similar inexpensive but strong material, and a table top of similar material, these two elements being connected by a hollow column or post which is essentially a stiff cardboard tube similar to a large mailing tube. An iron tie rod or stiff wire threaded at least at one end is fixed at one end to the underside of the table top and passes through the hollow column and base member so that a wine nut can be used to fasten the assembly rigidly together. The base is held off the floor by a raised rim on its underside to provide room for the wing nut. The entire assembly is preferably coated on all external sides with a plastic sheet material resembling wood, or any other desired finish may be applied.

Due to the lightness of the material and especially of the hollow column, such a table by itself would not have sufficient weight to feel like the wooden table it appears to be, and also would not have the desired stability to support heavy objects on the table top, which extends laterally well beyond the base. This is provided for in the present invention by loading the bottom of the hollow column with sand; however, loose sand would not serve very well as it shifts too easily. Adding cement and water to the sand also would not do because the cardboard of which the tube is made would absorb water from the cement mixture and swell and buckle. This is solved in the present case by adding a material such as hot wax to the sand, which stabilizes it without any deleterious swelling or distortion of the cardboard. Special closure means are provided for closing the ends of the column and receiving a thin central tube of metal through which the tie rods can pass without coming into contact with the sand. These closure means are specially made for easy and rapid assembly and also serve to strengthen the cardboard column.

The specific nature of the invention, as well as other objects and advantages thereof, will clearly appear from a description of a preferred embodiment as shown in the accompanying drawing, in which:

FIG. 1 is a side view, partly in section, of a table according to the invention;

FIG. 2 is a top view of the same table;

FIGS. 3–5 respectively show the hollow column, the tie rod, and the base of the table;

FIG. 6 is a sectional view taken on line 6—6 of FIG. 2, of the table:

FIG. 7 is a view similar to FIG. 6 of a modified form of the top part of the table; and FIG. 8 is a side view of one of the column closure pieces showing the struck-out barb portions.

As shown in the Figures, the table has a top 2, a supporting column 4, and a base 6. The top 2 and base 6 are each preferably made of a single sheet of synthetic material such as chipboard, Masonite, etc., covered, at least on the exposed top side, with an adhered layer of protective and decorative sheet material preferably resembling wood. Such materials are not readily available and can provide a highly realistic simulation of a rich wood surface. Furthermore, the table top may be provided with the representation of a chessboard, backgammon board, or any other desired playing surface. The edges of the top and base are provided with a decorative and protective snap-on trim 8, which can embody a storage trough preferably made of extruded plastic and applied as shown in U.S. pat. application Ser. No. 547,648, abandoned, of Myron E. Ullman, Jr., by fitting it to the edge and snapping it into grooves 10 previously made in the top by running shallow saw cuts along the proper lines. These pieces 8 are pre-cut into the desired length on the bias to provide the appearance of mitred joints as shown at 11. The trim 8 can be applied to the top at the factory, or provided in a kit form to be assembled by the user, since it can be applied to the board manually and without tools.

The base 6 is smaller than the top 2 but is similarly made, except that a hole 12 is provided in its center for the passage of the tie rod to be described below. However, its trim pieces 14 are applied oppositely to the top trim 8 so that when assembled the table will rest on the downwardly protruding sections 16, thus providing a space for the end of the tie rod 18 and nut 20.

Fixed to the center of the underside of table top 2, as by screwing or glueing, is a slab 22 preferably somewhat thicker than the table top 2. A cylindrically internally threaded nut 24 is firmly set in the center of this thin slab, preferably by driving it into a suitably dimensioned hole in the center of the slab, although it may be fixed in any suitable way, as by providing a flange 26 on the nut as shown in FIG. 7. If the table top is made thick enough, this slab can be omitted.

Column 4 is preferably made of heavy cardboard, at least 1/4 inch thick, like a mailing tube for large articles, and is typically in the order of 4 inches in diameter, and 18 inches long, with the outer surface preferably covered with plastic decorative and protective sheeting similar to the table top. Tie rod 18 is threaded into nut 24 and passes through the center of the column 4 and through base 6, and is engaged at its threaded end 19 by nut 20 to firmly hold the assembly together. Since sand is to be used to weight the bottom of the column, it is desirable to keep the sand confined within the column and for this purpose two rigid end plates 28 and 30 are provided, together with tube 31, which is preferably a piece of thin-walled electrical conduit of suitable length and diameter, for example, ¾ inch. The end plates are each provided with a center hole, and are struck inwardly at edges 32, 34 respectively, which provides extra strength and reinforcement, as well as a substantial engagement surface with the inner wall of the cardboard tube near end thereof. The rim of the center hole of each end plate is also struck in the same direction as 32 and 34, as shown at 36 and 38 respectively, and these struck-in portions are dimensioned to provide a snug fit with the inner tube 31, to which they are assembled preferably by means of a force fit. In assembling the unit, which is done at the factory, the tube is assembled to the bottom end plate 30 by a force fit. Any suitable sealing compound may be used, although barbs 40, struck from the rims 32 and 34 of plate 30 so that they protrude very slightly beyond the surface of the rim, serve to both insure a firm engagement with the cardboard, and also to prevent withdrawal of the end plate once it has been inserted. The sand 42 is then poured in from the top and hot wax or any non-aqueous stabilizing material added to stabilize the sand, after which the top end plate 28 is assembled to the column to complete it. The units consisting of the top, column and bottom are preferably sold as a kit to be assembled by the purchaser. This has the advantage of taking up less space for storage and shipment, and also makes the unit easily carried by the purchaser, since it can be packaged in a box small enough to be easily carried by a person.

In assembling the unit, the table is first placed upside down on the floor, and the tie rod 18 is threaded by hand into nut 24 as far as it will go. The column 4 is then slipped over the tie rod so that it passes through the inner tube 31, after which the base member is put on the tie rod so that its end protrudes through the hole 12 in the base 6, after which the nut 20 is applied by hand and the entire assembly suitably tightened. The dimensions of the tie rod are, of course, such that its extension together with the wing nut 20 protrude less than the portion 16 of the rim 14.

FIGS. 7 and 8 show a slight modification, wherein the top plate 28a is inverted with respect to the plate 28 shown in FIG. 6, so that the edge of its rim 32a coincides with the edge of the cardboard 2, and the base member 22a is provided with the groove 23 which snugly receives both rims, thus adding somewhat to the strength of the assembly. The struckout barb portions 33 are, of course, oriented oppositely to those shown at 40 in FIG. 6.

We claim:

1. In a knock-down kit of light weight table components including a top, a base, a supporting column, trim and a tie rod for quick assembly without tools, in combination the improvement comprising: a centrally located blind hole in the underside of said top; fastener means in said hole to secure an end of said tie rod therein; said supporting column including an outer hollow columnar member, an inner hollow columnar member within said outer columnar member, a pair of end plates adapted to concentrically position said columnar members, means to concentrically secure said end plates between said columnar members, ballast means between said columnar members adjacent their lower ends, and means to secure said ballast means adjacent said lower ends; a hole centrally located in said base; said trim being adapted to snap on the periphery of said base and to extend beneath the underside thereof; the length of said tie rod being sufficient to extend through said hole in said base, and said inner columnar member with one end projecting into said blind hole in the underside of said top to be secured by said fastener means therein; and means to fasten the outer end of said tie rod adjacent the underside of said base, said trim extension providing clearance for said means to fasten the said other end of said tie rod.

2. The knock-down table kit set forth in claim 1, said top being formed from a wood by-product with the upper surface of said top being provided with a simulated wood finish.

3. The knock-down table kit set forth in claim 1, said end plates having central apertures to receive said inner columnar member therethrough, the internal diameters of said apertures approximating the external diameter of said inner columnar member; and the outside diameters of said plates approximating the internal diameter of said outer columnar member to provide a press fit between said end plates and said columnar members.

4. The knock-down table kit set forth in claim 3, wherein said end plates are provided with internal and external edge flanges for abutting contact with said internal and external columnar members respectively.

5. The knock-down table kit set forth in claim 4, wherein said edge flanges are provided with gripping barbs to embed in the inside wall of said outer columnar member.

6. The knock-down table kit set forth in claim 5, wherein said outer columnar member has a yieldable inner wall to receive said gripping barbs therein.

7. The knock-down table kit set forth in claim 1, wherein said outer columnar member is formed from a wood pulp product the outer surface of which is provided with a simulated wood finish.

8. The knock-down table kit set forth in claim 1, said ballast means comprising sand and non-aqueous sand bonding means.

9. The knock-down table kit set forth in claim 1, said base being formed from a wood by-product with the upper surface of said base being provided with a simulated wood finish.

10. The knock-down table kit set forth in claim 1, wherein the underside of said base is provided with a groove adjacent its periphery, and said trim includes a web to abut against the edge of said base; and a pair of spaced apart flanges extending normally inwardly from said web to grip the upper and lower surfaces of said base therebetween, said web extending normally beyond the lower surface of said base, inwardly toward the center of said base, and then upwardly to engage said groove.

11. The knock-down table kit set forth in claim 1, wherein the upper surface of said top is provided with a groove adjacent its periphery, and said trim includes a web to abut against the edge of said top; and a pair of spaced apart flanges extending normally inwardly from said web to grip the upper and lower surfaces of said top therebetween, said web extending normally beyond the upper surface of said base, inwardly toward the center of said base, and then downwardly to engage said groove.

12. The knock-down table kit set forth in claim 9, wherein said tie rod is threaded on each end, a female threaded fastener is non-rotatably secured in the blind hole located in the underside of said top to threadedly receive one end of said tie rod; and a rotatable female threaded fastener is receivable on the other end of said tie rod to secure said other end to the underside of said base.

* * * * *